US011591551B2

(12) United States Patent
Tan et al.

(10) Patent No.: US 11,591,551 B2
(45) Date of Patent: Feb. 28, 2023

(54) NON-AQUEOUS AEROSOL FOAM AND METHODS OF MAKING THEREOF

(71) Applicant: Illinois Tool Works Inc., Glenview, IL (US)

(72) Inventors: Kirstie Tan, Glenview, IL (US); Tze-Lee Phang, Glenview, IL (US); Jiafu Fang, Glenview, IL (US); Ali Alwattari, Glenview, IL (US)

(73) Assignee: Illinois Tool Works Inc., Glenview, IL (US)

( * ) Notice: Subject to any disclaimer, the term of this patent is extended or adjusted under 35 U.S.C. 154(b) by 166 days.

(21) Appl. No.: 17/181,114

(22) Filed: Feb. 22, 2021

(65) Prior Publication Data

US 2021/0269752 A1 Sep. 2, 2021

Related U.S. Application Data

(60) Provisional application No. 62/982,224, filed on Feb. 27, 2020.

(51) Int. Cl.

| | |
|---|---|
| ***C11D 1/52*** | (2006.01) |
| ***C11D 1/58*** | (2006.01) |
| ***C11D 3/43*** | (2006.01) |
| ***C11D 7/50*** | (2006.01) |
| ***C10L 1/19*** | (2006.01) |
| ***C10L 1/224*** | (2006.01) |
| ***C10L 1/232*** | (2006.01) |
| ***C11D 17/00*** | (2006.01) |
| ***C11D 1/66*** | (2006.01) |
| ***C10L 1/12*** | (2006.01) |

(52) U.S. Cl.

CPC ..... *C11D 17/0043* (2013.01); *C10L 1/1208* (2013.01); *C10L 1/19* (2013.01); *C10L 1/224* (2013.01); *C10L 1/232* (2013.01); *C11D 1/521* (2013.01); *C11D 1/58* (2013.01); *C11D 1/667* (2013.01); *C10L 2300/20* (2013.01)

(58) Field of Classification Search

CPC .. C11D 1/52; C11D 1/521; C11D 1/58; C11D 1/667; C11D 3/43; C11D 3/373; C11D 7/50; C11D 11/0041; C11D 17/0043; C10L 1/19; C10L 1/1208; C10L 1/1291; C10L 1/224; C10L 1/232; C10L 2300/20

See application file for complete search history.

(56) References Cited

U.S. PATENT DOCUMENTS

2006/0228250 A1* 10/2006 Brown ..... A61L 9/01 422/123

* cited by examiner

*Primary Examiner* — Brian P Mruk

(74) *Attorney, Agent, or Firm* — Blue Filament Law PLLC

(57) ABSTRACT

A composition is provided for a non-aqueous foaming aerosol cleaner or lubricant. Foam builders, especially silicone glycol copolymers, are used to generate high density foam of the solvent-based formula. A cleaning product variant may be introduced via an air intake route for loosening deposits in an internal combustion engine. The high foam aerosol product dispenses easily without causing engine stalling. A process of lubricating a target substrate is also provided.

17 Claims, 4 Drawing Sheets

NON-AQUEOUS AEROSOL FOAM AND METHODS OF MAKING THEREOF

RELATED APPLICATIONS

This application is a non-provisional application that claim priority benefit of U.S. Provisional Application Ser. No. 62/982,224 filed 27 Feb. 2020; the contents of which are hereby incorporated by reference.

FIELD OF THE INVENTION

The present invention in general relates to non-aqueous foam compositions and the use thereof and in particular, to a foaming aerosol cleaner and lubricant.

BACKGROUND OF THE INVENTION

Consumer oriented packaged aerosol based cleaners that provide high foaming action are typically water-based. The foaming action of cleaners provides a perception of additional cleaning power to consumers. In addition, foam generally provides higher clinging power on the surface to be cleaned, enabling the active ingredient(s) of a cleaner ample time to penetrate and loosen up the dirt or residues on the applied surface. In applications where the desired air to liquid ratio is high, for example in engine combustion systems, the foam can minimize the chances of causing hydrolock of the engine. However, it is challenging to generate high foaming properties in non-aqueous aerosol products. Currently, there is no product in the automotive aftermarket that foams in a non-aqueous aerosol system.

Harmful engine deposits that build up over time degrade fuel economy, power, drivability, and other performance attributes. Even more prone to carbon deposits are the newer types of engines including gas direct injection (GDI) or turbo-GDI (tGDI). The regular "pour in" tank fuel additive might clean the GDI injectors or the combustion chamber deposits. However, these fuel additives will not be able to clean the build-up on the intake valves, throttle body, as well as the turbo compressor, as these components are not directly exposed to the fuel that has the additive cleaner mixed in.

Currently available solvent-based aerosol engine cleaning sprays are introduced via the throttle body route, or via the turbo inlet routes. Products introduced via these routes may be able to clean the throttle body, intake valves, and/or turbo wheels. However, these products are non-foaming and hence the speed of spraying such products into the engine requires a user with a high technical skill set to dispense it carefully and slowly to prevent an engine from stalling. Furthermore, if the cleaning spray dispenses too much liquid into the engine, the engine may hydrolock and cause permanent damage to the engine.

Similarly, most oil spray lubricants are made from petroleum oil, but some are made from vegetable oil, and they are non-foaming. Oil based spray lubricants work at freeing stuck parts by providing a sufficient amount of spray lubricant to allow enough soaking time to penetrate deep into mechanisms and into the threads of rusted bolts and nuts. In addition, the frequency of reapplying the lubricants increases, especially on vertical surfaces as the vertical orientation will channel the lubricants away.

Moreover, for part cleaner applications, the current solvent-based part cleaners in the market are also non-foaming. The color of the liquid of the solvent-based part cleaners is typically clear, and application on a surface makes it difficult to know whether a given area has been treated or not. However, with a powerful and visible foam spray, one can see much more clearly and may be certain that the product is doing its job. Moreover, the high foam provides a visual perception of excellent cleaning properties.

Therefore, there exists a need for a foaming non-aqueous composition for use as a turbo/throttle body engine cleaner which may be dispensed quickly without causing engine stalling or hydrolock the engine. There also exists a need for an oil spray lubricant which can enhance the clinging power on an applied surface to enhance the application time on the surface to penetrate and loosen up the rusted bolts and nuts. There further exists a need for a part cleaner to provide a visual indication of an application of the cleaner, application coverage, and cleaning effectiveness.

SUMMARY OF THE INVENTION

A non-aqueous foaming aerosol composition is provided that includes a foam builder, one or more organic solvents in which the foam builder is soluble or dispersible, and a propellant to aerosolize the composition. The foam builder, such as a silicone glycol copolymer is used to generate a high-density foam upon being expelled from a pressurized container with the solvent. The resulting volume of foam is three-times (3×) to twenty-times (20×) of its liquid volume with foam stability that last for at least 1-10 mins. These properties are ideal for a turbo/throttle body engine cleaner which requires a high ratio of air to liquid volume for smooth engine ingestion. Moreover, the high foam volume with good foam stability provides good clinging power, enhancing the dwelling time of the product to effectively deliver the target benefits of cleaning of dirt or soil, rust removal, part lubrication, etc. In addition, the expanded foams are highly visible and provides a good visual indication to a user that all surfaces are adequately covered.

With inclusion of additional powerful degreaser solvents and deposit control additive agents in addition to the foam builder, the foaming aerosol composition functions as a cleaning product that is well-suited to be introduced via an air intake to an internal combustion engine. The high foam aerosol product dispenses without causing engine stalling. The high foam composition is also ideal as a part cleaner, as the foaming action enhances the dwelling time on applied surfaces that allows additional time for the cleaner to loosen up the tough carbon soil and provide a visual perception of cleaning to the user. The foaming aerosol composition with inclusion of lubricant oils and an anticorrosion agent make the composition suitable as a spray lubricant or penetration oil. The foaming aerosol composition enhances the dwelling time on applied surfaces that allows additional time to let the oils penetrate deep into the targeted area to do their jobs.

The non-aqueous foaming aerosol composition inclusive of cleaning surfactants or lubricants is not corrosive towards metal surfaces of dispensing aerosol container.

BRIEF DESCRIPTION OF THE DRAWINGS

The present invention is further detailed with respect to the following drawings that are intended to show certain aspects of the present invention, but should not be construed as a limit on the practice of the present invention.

DETAILED DESCRIPTION OF THE PREFERRED EMBODIMENTS

Figure 1:
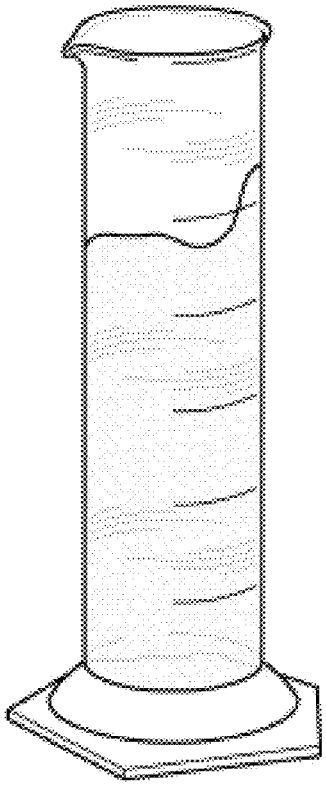
FIG. 1 is a photograph that illustrates the foaming action of a composition in accordance with an embodiment of the invention.

The present invention has utility as a composition for a non-aqueous foaming aerosol cleaner. Specific inventive embodiments utilize a foaming builder to generate high density foam upon being expelled from a pressurized container. The resulting non-aqueous foam has the attribute of clinging to target surfaces to which it is applied. Due to high air to liquid ratio of inventive embodiments of the high foam aerosol products, when used as a cleaning product introduced via an air intake route for internal combustion engine, the high foam aerosol product dispenses easily without causing engine stalling. Moreover, the embodiments of the non-aqueous inventive foaming composition present a low risk of corrosion toward the metal surfaces of a dispensing aerosol container.

Embodiments of the inventive non-aqueous foaming aerosol composition include a foam builder, one or more organic solvents in which the foam builder is soluble or dispersible, and a propellant to aerosolize the composition. The foam builder, such as a silicone glycol copolymer is used to generate a high-density foam upon being expelled from a pressurized container with the solvent. The resulting volume of foam is three-times (3×) to twenty-times (20×) of its liquid volume with foam stability that last for 1 to 10 min. These properties are ideal for a turbo/throttle body engine cleaner which requires a high ratio of air to liquid volume for smooth engine ingestion. Moreover, the high foam volume with good foam stability provides good clinging power, enhancing the dwelling time of the product to effectively deliver the target benefits of cleaning of dirt or soil, rust removal, part lubrication, etc. In addition, the expanded foams are highly visible and provides a good visual indication to a user that all surfaces are adequately covered.

In specific inventive embodiments with the inclusion of additional powerful degreaser solvents and deposit control additive agents in addition to the foam builder, the foaming aerosol composition may function as a cleaning product that is well-suited to be introduced via an air intake to an internal combustion engine. The high foam aerosol product dispenses without causing engine stalling. The high foam composition is also ideal as a part cleaner, as the foaming action enhances the dwelling time on applied surfaces that allows additional time for the cleaner to loosen up the tough carbon soil and provide a visual perception of cleaning to the user. The foaming aerosol composition with inclusion of lubricant oils and an anticorrosion agent make the composition suitable as a spray lubricant or penetration oil. The foaming aerosol composition enhances the dwelling time on applied surfaces time that allows additional time to let the oils penetrate deep into the targeted area to do their jobs.

As used herein "high density" in the context of foam is defined as a foam having an air to liquid ratio of 3-20:1 on a volume to volume basis.

Embodiments of the inventive non-aqueous foaming aerosol cleaner solves many of the problems of existing solvent-based aerosol spray products. Inventive embodiments of the non-aqueous foaming cleaner composition can be aerosolized with low risk of container corrosion and as a result have commercially acceptable shelf storage times of more than 1 year. The foaming properties of the present invention allow the engine to ingest the composition smoothly through the throttle body or turbo inlet and with the addition of powerful degreaser additives/solvents, it cleans the internal engine part effectively. The engine deposits are softened by embodiments of the inventive non-aqueous foaming aerosol containing surfactants so as to function as a cleaner. The engine deposits are removed from the internal combustion engine components such as the turbo compressor and turbine wheel, throttle body, intake valves, injectors, and combustion chamber. Embodiments of the inventive non-aqueous foaming aerosol cleaner composition are tailored to be volatile organic component (VOC) free and/or are VOC compliant.

As used herein, VOC is defined per 40 CFR Part 51.100 as of the Dec. 1, 2019.

It is to be understood that in instances where a range of values are provided, for example with respect to a weight percentage range of a composition component, that the range is intended to encompass not only the end point values of the range but also intermediate values of the range as explicitly being included within the range and varying by the last significant figure of the numeral. By way of example, a recited range of from 1 to 4 is intended to include 1-2, 1-3, 2-4, 3-4, and 1-4.

It is appreciated that while the following embodiments for the inventive non-aqueous foaming aerosol cleaner are discussed with respect to an engine cleaner, and more specifically for use in a turbo GDI engine, embodiments of the inventive composition may be tailored for different cleaning applications as will be discusses further below.

Embodiments of the inventive non-aqueous foaming aerosol cleaner composition include solvents, foam builders, cleaning agents, additives, and a propellant to aerosolize the composition.

A foam builder operative herein is a surfactant that is soluble in water, alcohol, and hydro-alcoholic systems. The foam builders operative herein are a silicone glycol copolymer having a weight average molecular weights in the range of 30-30,000; viscosity in the range of 5-4,000 cSt; and siloxane content of 10-80%.

Solvents operative herein to dissolve or disperse the foam builder are non-aqueous and compatible with the foam builder and aerosol container, but otherwise without limitation. VOC exempted solvents operative herein illustratively include aromatic 200, and acetone mixtures. Other solvents operative herein illustratively include glycol, mineral spirit, ketone, alcohol, hydrocarbon (linear or aromatic), oil, etc. It is appreciated that solvents may also confer cleaning benefits in certain contexts in dissolving or penetrating a target deposit.

Cleaning agents tailored for the surface to be cleaned and dirt expected to be encountered on the surface vary depending on the applications. For the application of Turbo/GDI Cleaner Aerosol, cleaning agents are ingredients that have strong degreasing properties and/or amine-based fuel additives. The degreasing agents may be surfactants and/or aprotic solvents to soften the carbon deposits like N,N-dimethyl 9-decenamide, butan-1-yl-3-hydroxybutanoate; butyl3-hydroxybutyrate, 1-butylpyrrolidin-2-one. The amine-based fuel additives illustratively include polyether amine (PEA), polyisobutylene amine (PIBA), hydrocarbyl amine, and/or other deposit control additives.

Additives used in some embodiments of the inventive non-aqueous foaming aerosol cleaner composition are a colorant, a fragrance, a wetting agent, or a combination thereof.

Propellants are used to aerosolize the composition to build up the foam and to provide strong pressure when spraying. The strong force when spraying embodiments of the inventive composition can help to immediately remove deposits and/or varnish surfaces, especially from the throttle body and/or turbo impeller/compressor wheel as this is where the liquid flows through first. Suitable propellants include those that are unreactive towards the composition and illustratively include alkanes such as butane, pentane, isobutane, propane; ethers such as dimethyl ether, diethyl ether, nitrogen; halogenated hydrocarbons; carbon dioxide and combinations thereof. Typical loadings of propellant in an inventive composition range from 3 to 25 total weight percent.

Embodiments of the inventive composition for the non-aqueous foaming aerosol cleaner may be transformed from a cleaner to a spray lubricant by modifying the composition. There is currently no expanding/lathering consumer spray lubricant in the marketplace. The composition may be modified with the inclusion of lubricant additives illustratively including polytetrafluoroethylene (PTFE), silicone oil with different viscosity grades, friction modifiers (ZDDP, HiTEC 7118), graphite, graphene, boric acid, corrosion inhibitor, and base oil. A lubricant, if present, is present from 1 to 50 total weight percent.

Polytetrafluoroethylene (PFTE) has a variety of uses, illustratively including lubricating chains and cables. Even though it's chemically different, PTFE has lubricative characteristics similar to silicone. PTFE is well suited as a lubricant in consumer setting such as kitchen drawers and cabinet hinges.

Silicone sprays typically contain only about 1.5% silicone lubricant. Silicone spray repels water and performs well in extreme temperatures. Thin and clear, silicon sprays are also good when neatness counts. In addition to metal, silicone is often safe to use on rubber, wood, nylon, vinyl, and plastic parts. Many sprays are also food safe.

Dry spray lubricants leave a dry film. Graphite, graphene, and boric acid are exemplary of dry lubricants. Dry lubricants are well suited for interior hinges, interior locks, drawer slides, and toolbox drawers. The main advantages of dry lubricants are that there is no oily mess and that dust and dirt don't stick to them. Dry lubricants do not displace water, and they wear off fairly quickly under load, making it necessary to reapply them more frequently than other lubricants.

Oils are typically referred to as penetrating oils. Most oil spray lubricants are derived from petroleum oil or plant sources. The low surface tension of oil makes them well suited for penetrating deep into mechanisms and into the threads of rusted bolts and nuts.

Embodiments of the inventive non-aqueous foaming aerosol cleaner composition are advantageous over traditional auto part cleaners in providing a non-drip liquid that increases contact without resort to a vat of liquid in which to soak a target part. Auto body surfaces may be cleaned with the inventive composition to remove auto stains including bugs, tar, and tree sap. In addition, the inventive composition may be used as a wheel cleaning formulation that is ideal for removal of brake dust and stains from wheels.

Typical and preferred compositions according to the present invention are provided in Table 1. FIG. 1 is a photograph that illustrates the foaming action of inventive formula 1.

TABLE 1

Inventive Non-aqueous Foaming Aerosol Composition (amounts in total weight percent)

| Ingredient | Weight % | Preferred, if present |
|---|---|---|
| Foam Builder | 3-20 | 5-15 |
| Cleaning Degreaser | 1-20 | 1-15 |
| Cleaning Fuel Additive | 0-5 | 0-1 |
| Other Additives (like Wetting Agent, Colorant, Fragrance, etc) | 0-20 | 5-15 |
| Lubricant | 0-50 | 0.5-30 |
| Propellant | 3-25 | 5-10 |
| Solvent | Remainder | Remainder |

The present invention is further detailed with respect to the following nonlimiting examples that are provided to further illustrate the preparation of inventive compositions and certain attributes associated with the resulting coatings on tire surfaces.

EXAMPLES

Example 1

Figure 2A:
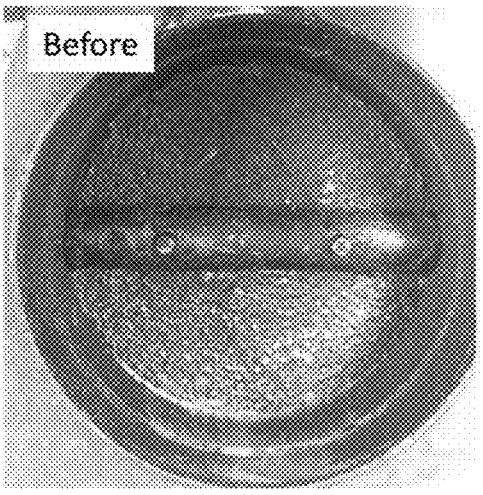
FIGS. 2A-2C show, before, during, and after photographs, respectively, of a throttle body treated with the non-aqueous foaming aerosol cleaner in accordance with embodiments of the invention.
Figure 2B:
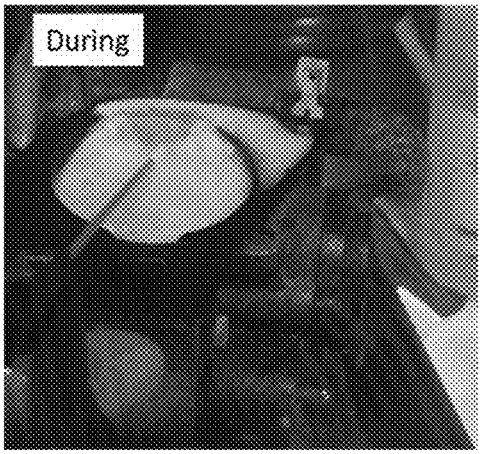
Figure 2C:
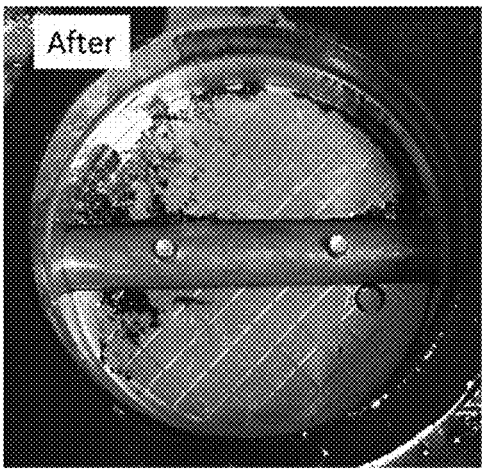

A bench top test was conducted using an embodiment of the non-aqueous foaming aerosol cleaner composition to show the effectiveness of cleaning carbon deposits from a throttle body. FIG. 2A shows the throttle body covered in carbon deposits prior to application of the non-aqueous foaming aerosol cleaner composition. FIG. 2B shows the application of the cleaning compound and the foaming action on the surface of the throttle body. FIG. 2C shows the throttle body with a vast majority of the carbon deposits effectively removed.

Example 2

A test was conducted to determine the effectiveness of the ingestion of an embodiment of the non-aqueous foaming aerosol cleaner composition in a gas direct injection (GDI) engine.

Figure 3A:
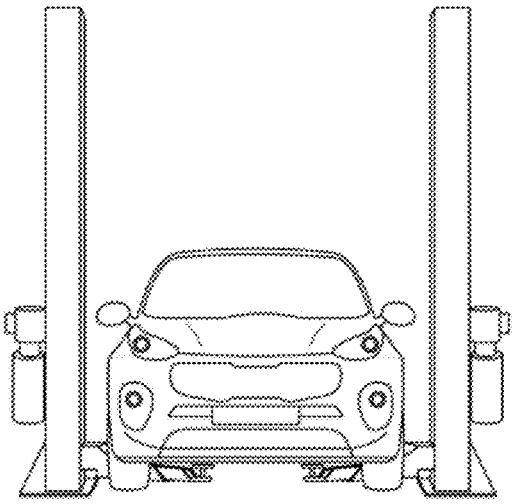
FIGS. 3A-3C show a vehicle and before and after photos of the intake valves, respectively, of a gas direct injection (GDI) engine treated the non-aqueous foaming aerosol cleaner in accordance with embodiments of the invention.
Figure 3B:
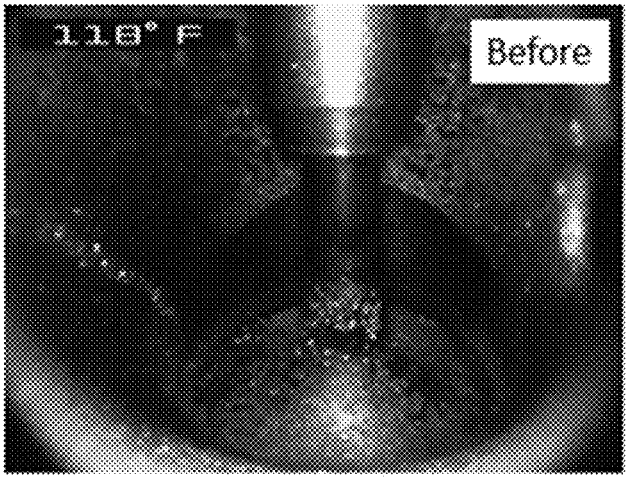
Figure 3C:
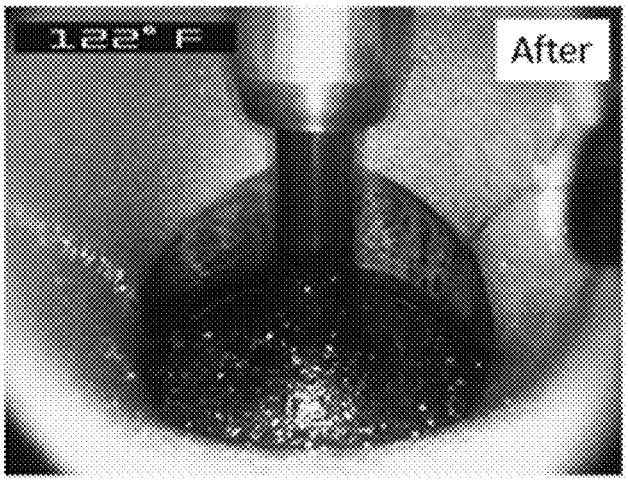

Test results on the actual GDI car of FIG. 3A showed the engine ingested the product well. The vehicle tested was a four-cylinder, two-liter engine with direct gasoline injection fuel system that had a naturally aspirated induction system. The vehicle was driven for six miles after the engine treatment. FIG. 3B is a before picture of an intake valve full of carbon deposits. FIG. 3C shows the intake valve cleaned with the non-aqueous foaming aerosol cleaner. The product cleaned the internal combustion engine components, including the intake valves (as shown), which a regular pour-in-tank fuel additive product could not reach.

Example 3

A test was conducted to determine the effectiveness of the ingestion of an embodiment of the non-aqueous foaming aerosol cleaner composition in a turbo-GDI (tGDI) engine.

Figure 4A:
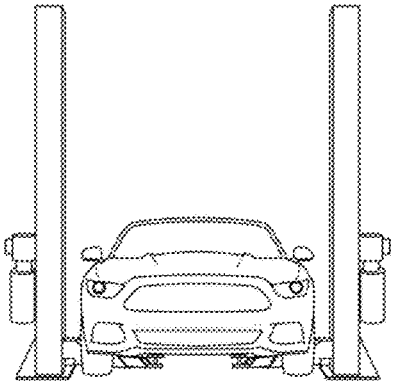
FIGS. 4A-4E show a vehicle, and before and after photos of the intake valves and turbo-turbine, respectively, of a turbo-GDI (tGDI) engine treated the non-aqueous foaming aerosol cleaner in accordance with embodiments of the invention.
Figure 4B:
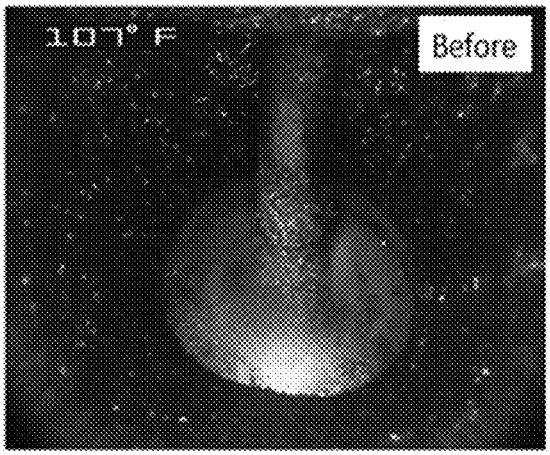
Figure 4C:
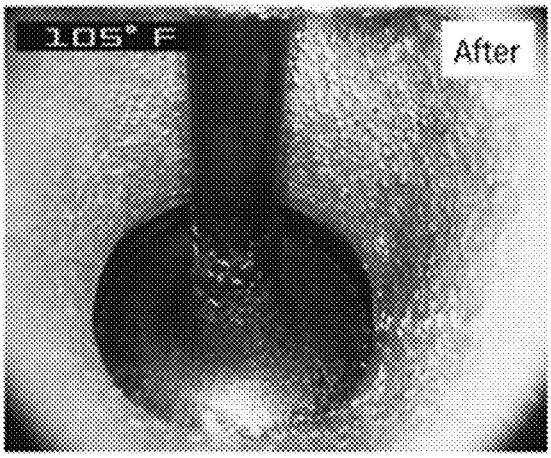
Figure 4D:
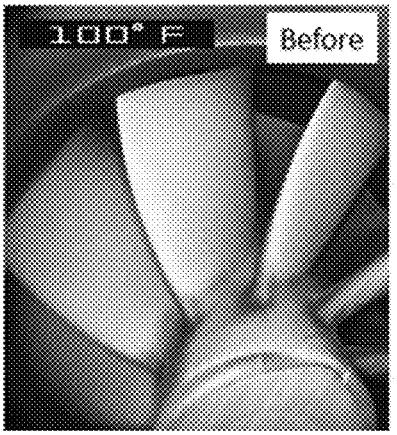
Figure 4E:
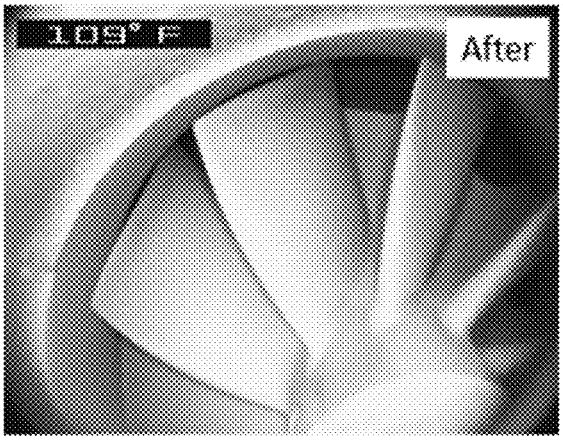

Test results on the actual GDI car of FIG. 3A showed the engine ingested the product well. The vehicle tested was a 2019 Ford Mustang with a four-cylinder 2.3 liter engine with direct gasoline injection fuel system that had a turbocharger system. The vehicle was driven for six miles after the engine treatment. FIG. 4B is a before picture of an intake valve full of carbon deposits. FIG. 4C shows the intake valve cleaned with the non-aqueous foaming aerosol cleaner. FIG. 4D is a before picture of a turbo turbine wheel with carbon deposits. FIG. 4E shows the turbo turbine wheel cleaned with the non-aqueous foaming aerosol cleaner. The product cleaned the internal combustion engine components, including the turbo turbine wheel and intake valves, which the regular pour-in-tank fuel additive product could not reach.

Patents and publications mention the specification are indicative of the levels of those skilled in the art to which the invention pertains. These patents and publications are incorporated herein by reference to the same extent as if each individual patent or publication was specifically and individually incorporated herein by reference.

The forgoing description is illustrative of particular embodiments of the invention, but is not meant to be a limitation upon the practice thereof. The following claims, including all equivalents thereof are intended to define the scope of the invention.

The invention claimed is:

1. A non-aqueous foaming aerosol composition, said composition comprising:

a foam builder that is a silicone glycol copolymer that soluble in water, alcohol, and hydro-alcoholic systems, silicone glycol copolymer having a weight average molecular weights in the range 30-30,000; viscosity in the range of 5-4,000 cSt; and siloxane content of 10-80%;

one or more non-aqueous solvents in which said foam builder is dissolved or dispersed;

an active component of cleaning agent or a lubricant; and a propellant to aerosolize said foam builder and said one or more non-aqueous solvents.

2. The composition of claim 1 wherein the one or more solvents are volatile organic component (VOC) free or VOC compliance.

3. The composition of claim 1 wherein the one or more solvents include aromatic 200 and acetone mixtures.

4. The composition of claim 1 wherein said cleaning agent is present.

5. The composition of claim 4 wherein said cleaning agent includes a surfactant that is an anionic, cationic, or nonionic surfactant distinct from said foam builder.

6. The composition of claim 5 wherein said cleaning agent is a degreasing agent of one or more aprotic solvents.

7. The composition of claim 6 wherein said cleaning agent is one or more of N,N-dimethyl 9-decenamide, butan-1-yl-3-hydroxybutanoate; butyl3-hydroxybutyrate, or 1-butylpyrrolidin-2-one.

8. The composition of claim 1 wherein said cleaning agent is an amine-based fuel additive.

9. The composition of claim 8 wherein said amine-based fuel additive is one or more of polyether amine (PEA), polyisobutylene amine (PIBA), or hydrocarbyl amine.

10. The composition of claim 1 further comprising a wetting agent.

11. The composition of claim 1 wherein said propellant is at least one of a hydrocarbon propellant, a compressed gas, or a fluorinated propellant.

12. The composition of claim 1 wherein said lubricant is present.

13. The composition of claim 12 wherein the lubricant is one or more of: polytetrafluoroethylene (PTFE), silicone oil, a dry lubricant, corrosion inhibitor, or a base oil.

14. The composition of claim 13 wherein said lubricant is graphite.

15. A process of loosening deposits in an internal combustion engine comprising:

injecting the composition according to claim 1 into the engine; and allowing sufficient time for the composition to foam into contact with the deposits and loosen the deposits.

16. A process of lubricating a target substrate comprising:

spraying the composition according to claim 1 onto the substrate; and allowing sufficient time for the composition to foam to disperse lubricant in the foam.

17. The process of claim 16 wherein the target substrate is a vehicle.

* * * * *